US005409797A

United States Patent [19]

Hosoi et al.

[11] Patent Number: 5,409,797

[45] Date of Patent: Apr. 25, 1995

[54] HEAT-SENSITIVE RECORDING MATERIAL FOR LASER RECORDING

[75] Inventors: Noriyuki Hosoi; Masao Yabe; Naoto Yanagihara, all of Shizuoka, Japan

[73] Assignee: Fuji Photo Film Co., Ltd., Kanagawa, Japan

[21] Appl. No.: 117,555

[22] Filed: Sep. 7, 1993

Related U.S. Application Data

[63] Continuation-in-part of Ser. No. 845,259, Mar. 3, 1992, abandoned.

[30] Foreign Application Priority Data

| | | | |
|---|---|---|---|
| Mar. 4, 1991 | [JP] | Japan | 3-62683 |
| Mar. 4, 1991 | [JP] | Japan | 3-062684 |
| Apr. 3, 1991 | [JP] | Japan | 3-099511 |
| May 2, 1991 | [JP] | Japan | 3-130417 |
| May 14, 1991 | [JP] | Japan | 3-138382 |

[51] Int. Cl.[6] ..... F41M 5/28; G03C 1/72

[52] U.S. Cl. ..... 430/138; 346/46; 430/944; 430/964; 430/348; 430/349; 430/350; 430/351; 430/171; 430/157

[58] Field of Search ..... 346/46; 430/138, 157, 430/171, 201, 200, 348, 349, 350, 351, 944, 964

[56] References Cited

U.S. PATENT DOCUMENTS

| | | | |
|---|---|---|---|
| 4,745,046 | 5/1988 | Borror et al. | 430/964 |
| 4,760,048 | 7/1988 | Kurihara et al. | 430/138 |
| 4,788,124 | 11/1988 | Wright | 430/349 |
| 4,788,128 | 11/1988 | Borlow | 430/201 |
| 4,816,367 | 3/1989 | Sakojiri et al. | 430/138 |
| 4,904,561 | 2/1990 | Yamamoto | 430/138 |
| 4,916,042 | 4/1990 | Sakojiri et al. | 430/138 |
| 4,937,159 | 6/1990 | Gottschalk et al. | 430/138 |
| 4,950,639 | 8/1990 | DeBoer et al. | 430/201 |
| 4,956,251 | 9/1990 | Washizu et al. | 430/138 |
| 4,956,254 | 9/1990 | Washizu et al. | 430/138 |
| 4,965,166 | 10/1990 | Hosoi et al. | 430/138 |
| 4,973,572 | 11/1990 | DeBoer | 430/201 |
| 5,036,040 | 7/1991 | Chapman et al. | 430/201 |
| 5,047,308 | 9/1991 | Usami | 430/138 |
| 5,064,951 | 11/1991 | Yamasaki | 430/964 |
| 5,104,767 | 4/1992 | Nakamura | 430/138 |
| 5,198,321 | 3/1993 | Hosoi et al. | 430/138 |
| 5,219,703 | 6/1993 | Bugner et al. | 430/200 |
| 5,246,909 | 9/1993 | Thien et al. | 430/200 |

FOREIGN PATENT DOCUMENTS

| | | | |
|---|---|---|---|
| 3906867 | 9/1989 | Germany | 430/138 |
| 1238687 | 9/1989 | Japan . | |
| 2153782 | 6/1990 | Japan . | |

*Primary Examiner*—Charles L. Bowers, Jr.
*Assistant Examiner*—Martin J. Angebranndt
*Attorney, Agent, or Firm*—Sughrue, Mion, Zinn, Macpeak & Seas

[57] ABSTRACT

A heat-sensitive recording material for laser recording is provided including a support having thereon a heat-sensitive layer including at least a first substantially colorless coloring component, a second substantially colorless coloring component which reacts with the first substantially colorless coloring component to develop a color, and an infrared-absorbing dye.

9 Claims, No Drawings

HEAT-SENSITIVE RECORDING MATERIAL FOR LASER RECORDING

This is a continuation-in-part of application No. 07/845,259, filed Mar. 3, 1992 now abandoned.

FIELD OF THE INVENTION

The present invention relates to a heat-sensitive recording material. More particularly, the present invention relates to a non-contact heat-sensitive recording material on which recording is carried out by using a laser beam.

BACKGROUND OF THE INVENTION

A heat-sensitive recording system is widely known in which a thermal head is allowed to scan in close contact with the surface of a heat-sensitive recording material comprising a heat-sensitive coloring layer on a support so that heat energy is transferred to the heat-sensitive coloring layer directly or through a protective layer to record a color image thereon. This heat-sensitive recording system is employed in a facsimile, printer, etc. However, since the thermal head is allowed to scan in close contact with the heat-sensitive recording material, the thermal head wears out or tailings of the components of the heat-sensitive recording material are attached to the surface of the thermal head, causing the problem that correct recorded images cannot be obtained or the thermal head is destroyed.

Furthermore, the heat-sensitive recording system using such a thermal head is disadvantageous in that the structural properties of the thermal head restrict the high speed control of heating and cooling of the heating elements and the density of the heating elements, giving a limit to the speed, density and quality of recording.

In order to eliminate the above-mentioned difficulties of a heat-sensitive recording system using a thermal head, a system in which a laser beam is used to effect recording at a high speed and a high density in such a manner that the thermal head is not brought into contact with the heat-sensitive recording material has been proposed, as disclosed in JP-A-50-23617, JP-A-54-121140, JP-A-57-11090, JP-A-57-14095, JP-A-57-14096, JP-A-58-56890, JP-A-58-94494, JP-A-58-134791, JP-A-58-145493, JP-A-59-89192, JP-A-60-205182, and JP-A-62-56195 (the term "JP-A" as used herein means an "unexamined published Japanese patent application").

However, such a recording system using a laser beam is disadvantageous in that since a heat-sensitive coloring layer generally can hardly absorb visible light and near infrared rays, the laser power must be considerably great to obtain the heat energy required for coloring, making it extremely difficult to provide a small-sized and inexpensive apparatus.

JP-B-50-744 (term "JP-B" as used herein means an "examined Japanese patent publication") proposes a system in which a paper coated with microcapsules containing an ink is irradiated with a strong light so that the ink is released from the microcapsules to effect recording thereon. However, this system exhibits a very low sensitivity and thus is not yet realized.

Many proposals have been made to allow the heat-sensitive coloring layer to efficiently absorb a laser beam. In most cases, a light-absorbing substance that fits to the wavelength of a laser beam used is incorporated in the heat-sensitive coloring layer. In this case, if the light-absorbing substance to be used is not white, the background of the recording material is colored, giving a low contrast and unrefined record. Further, if the light-absorbing substance added is not present in the portion requiring direct heating, a recording material with a reduced sensitivity is provided.

In general, colorless or white light-absorbing substances occur mostly in the form of inorganic compounds. However, most of these inorganic compounds exhibit a low light absorption efficiency., Accordingly, even if the light absorption efficiency itself is improved by incorporating a light-absorbing substance, if the heat-sensitive coloring layer is opaque, laser beam is partially reflected, and the amount of laser beam absorbed by the heat-sensitive layer is reduced, making it impossible to record images. Therefore, it has been desired to develop an organic compound with an excellent light absorption efficiency which is little colored. Further, it has been desired to obatin a transparent recording layer for the purpose to form a transmitted image and a multicolored image by a multilayer coating.

In recent years, semiconductor lasers have shown a remarkable progress, and small-sized and inexpensive semiconductor lasers have been available. However, since the oscillation wavelength of these semiconductor laser is in the near infrared range, it has been desired to develop a heat-sensitive recording material which can absorb light in the near infrared range to effect heat recording.

However, organic compounds which absorb visible light are normally colored. The darker these organic compounds are colored, the higher is their light absorption efficiency. Therefore, the sensitivity of the heat-sensitive recording material can be increased by incorporating these organic compounds in the heat-sensitive recording layer (hereinafter referred to as "heat-sensitive layer") as a light-absorbing substance. However, it is difficult to improve the whiteness of the recording paper by using these organic compounds.

The heat sensitivity of the recording material can be improved by increasing the added amount of the light-absorbing substance. However, since the recording material itself is colored dark in proportion to the added amount of the light-absorbing substance, it is difficult to provide an excellent recorded image.

However, colored organic compounds with an excellent efficiency of absorbing a laser beam, if they can render themselves colorless after recording by a laser beam, can render the heat-sensitive layer in the recording material colorless and thus render the background of the recording material white or colorless after image recording, enabling the improvement in the heat sensitivity by the increase in the content of these organic compounds while improving the image quality.

On the other hand, if an organic compound which does not absorb visible light but absorbs a laser beam of a wavelength outside the visible range is used, the background of the recording material can be rendered white even if it is incorporated in the heat-sensitive layer because it is not colored. However, the kind of these organic compounds which can be added is limited.

U.S. Pat. No. 4,816,367 proposes a multicolor imaging material in which heat-meltable micorcapsules containing a color former and an infrared absorbent in the wall or inside of the microcapsules and a developer exist in the same layer or different layers. Also, U.S. Pat. No. 4,916,042 process a multicolor imaging material comprising a support having provided thereon a diazo compound, a coloring assistant and heat-meatable microcapsules having a porous membrane which encloses the coupling component and a capsule wall which includes the infrared absorbent. However, since the infrared absorbent in contained in the wall or inside of the microcapsules, it is difficult to incorporate a large enough amount of the infrared absorbent in the microcapsules, making it difficult to obtain a laser power required for providing an excellent recorded image. Further, since the capsule wall is heat-meltable, the storage stability is poor. In these U.S. patents, there is no disclosure with respect to a method of providing a heat-sensitive recording material for an infrared laser with an excellent transparency.

Also, U.S. Pat. No. 5,198,321 proposes an image forming method comprising bringing a transparent heat-sensitive recording material into contact with an infrared-absorbing layer, irradiating with a laser beam to recored an image, and separating the infrared-absorbing layer and the heat sensitive recording material from each other. However, since the heat-developed portion and colored portion are different layers, it is difficult to obtain a sufficient sensitivity. Further, this method suffers from the defect that the heat-developed portion needs to be disposed as waste.

As a result of extensive studies to obtain a highly refined heat-sensitive recording material with a nearly white background capable of non-contact recording, the inventors found that a heat-sensitive layer formed by the coating of a coating solution containing an emulsion obtained by the emulsion dispersion of a solution of a coloring component and an infrared-absorbing dye in an organic solvent slightly soluble or insoluble in water exhibits an excellent transparency and thus can efficiently absorb infrared rays without scattering, enabling excellent image recording with an infrared laser beam while rendering the background of the heat-sensitive recording material almost white. Thus, the present invention was developed.

SUMMARY OF THE INVENTION

A first object of the present invention is to provide a heat-sensitive recording material for an infrared laser which is little colored on its background and enables a highly refined recording with an excellent sensitivity.

A second object of the present invention is to provide a heat-sensitive recording material for an infrared laser with an excellent image storage stability.

A third object of the present invention is to provide a heat-sensitive recording material having a nearly white background which enables a highly refined image recording with a laser beam.

A fourth object of the present invention is to provided a heat-sensitive recording material for an infrared laser with an excellent transparency.

These and other objects of the present invention will become more apparent from the following detailed description and examples.

These objects of the present invention are accomplished with a heat-sensitive recording material for laser recording comprising a support having thereon a heat-sensitive layer comprising at least a first substantially colorless coloring component, a second substantially colorless coloring component which reacts with said first substantially colorless coloring component to develop a color, and an infrared-absorbing dye, wherein the first substantially colorless coloring component is present in microcapsules and the infrared-absorbing dye is present outside microcapsules, wherein the first substantially colorless coloring component is a photodecomposable diazo compound and the second substantially colorless coloring component is a coupler, or the first substantially colorless coloring component is an electron-donating dye precursor and the second substantially colorless coloring component is a developer, and wherein the heat-sensitive layer is formed by coating a coating solution containing an emulsion obtained by dissolving the second coloring component and infrared-absorbing dye in an organic solvent slightly soluble or insoluble in water, and then emulsion-dispersing the solution in an aqueous medium.

DETAILED DESCRIPTION OF THE INVENTION

The coloring components (color former and developer) to be used in the present invention are preferably colorless components which undergo a color development reaction on the basis of contact of the substances, particularly a combination of photo-decomposable diazo compound (color former) and coupler (coupling compound, developer) or a combination of electron-donating dye precursor (color former) and acidic substance (developer).

The diazo compound as used herein is a photo-decomposable diazo compound which undergoes reaction with a developer called a coupling component as later described to develop a color with a desired hue but, when acted on by light of a specific wavelength before the reaction, decomposes and no longer develops a color even when acted on by a coupling component. The color hue in this color development system is mainly by a diazo dye produced by the reaction of the diazo compound with the coupling component. Accordingly, as well known, the color hue can be easily changed by changing the chemical structure of the diazo compound or the coupling component. By properly selecting the combination of these chemical structures, almost any color hues can be obtained. Therefore, various diazo compounds may be incorporated in one layer while one coupling component and other additives may be incorporated in the same layer. In this case, each unit coloring group consists of different diazo compounds, a coupling component common to others, and other additives.

In some combinations, different coupling components are incorporated in several layers and the same diazo compound and other additives are incorporated in each of these layers. In this case, each unit coloring group consists of different coupling components, a diazo compound common to others, and additives. In any case, each unit coloring group consists of one or more diazo compounds and one or more coupling components combined such that different color hues are obtained, and other additives.

The photo-decomposable diazo compound as used herein is mostly an aromatic diazo compound, more particularly a compound such as an aromatic diazonium salt, diazosulfonate compound and diazoamino compound.

The diazoninium salt is a compound represented by the general formula $ArN_2^+X^-$ (in which Ar represents a substituted or unsubstituted aromatic group portion, $N_2^+$ represents a diazonium group, and $X^-$ represents an acid anion).

It is generally said that the photo-decomposition wavelength of a diazonium salt is its maximum absorption wavelength. It is also known that the maximum absorption wavelength of a diazoniumsalt varies from 200 nm to 700 nm depending on its chemical structure (Takahiro Tsunoda and Ao Yamaoka, "Kankosei Diazonium En no Hikari Bunkai to Kagaku Kozo (Photodecomposition and Chemical Structure of Light-sensitive Diazonium Salt)", Nihon Shashin Gakkai-shi 29 (4), pp. 197–205 (1965)). In other words, when a diazoniumsalt is used as a photo-decomposable compound, it undergoes photo-decomposition by light of a specific wavelength depending on its chemical structure. Furthermore, when the diazonium salt has a different chemical structure, the color hue of a dye which has undergone a coupling reaction with the same coupling component will be different.

As a light source for photo-decomposition, any kind of light source which emits light of a desired wavelength can be used. Examples of such a light source include various fluorescent lamps, xenon lamps, xenon flash lamps, mercury vapor lamps with various pressures, photographic flashes, and strobes. In order to provide a compact light-fixing zone, the light source portion and the exposure portion may be separated by an optical fiber.

Examples of diazonium compounds which exhibit a photo-decomposition wavelength in the vicinity of 400 nm include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, and 4-diazo-1,4-methoxybenzoylamino-2,5-diethoxybenzene. Examples of diazonium compounds which exhibit a photo-decomposition wavelength in the range of 300 to 370 nm include 1-diazo-4-(N,N-dioctylcarbamoyl), benzene, 1-diazo-2-octadecyloxybenzene, 1-diazo-4-(4-tert-octylphenoxy)-benzene, 1-diazo-4-(2,4-di-tert-amylphenoxy) benzene, 1-diazo-2-(4-tert-octylphenoxy)benzene, 1-diazo-5-chloro-2-(4-tert-octylphenoxy)benzene, 1-diazo-2,5-bis-octadecyloxybenzene, 1-diazo-2,4-bis-octadecyloxybenzene, and 1-diazo-4-(N-octyllauroylamino)benzene. Aromatic diazonium compounds exemplified by these examples can widely vary their photo-decomposition wavelength by properly altering their substituents.

Specific examples of acid anions include $C_nF_{2n+1}COO^-$ (in which n represents an integer 3 to 9), and $C_mF_{2m+1}SO_3^-$ (in which m represents an integer 2 to 8).

Many known compounds may be used as diazosulfonates suitable for the present invention. These diazosulfonates can be obtained by treating diazonium salts with a sulfite.

Preferred among these compounds are benzenediazosulfonates containing substituents such as 2-methoxy, 2-phenoxy, 2-methoxy-4-phenoxy, 2,4-dimethoxy, 2-methyl-4-methoxy, 2,4-dimethyl, 2,4,6-trimethyl, 4-phenyl, 4-phenoxy and 4-acetamide or benzenediazosulfonates containing substituents such as 4-(N-ethyl, N-benzylamino), 4-( N,N-dimethylamino ), 4-(N,N-diethylamino ), 4-(N,N-diethylamino)-3-chloro, 4-pyrogenino-3-chloro, 4-morpholino-2-methoxy, 4-( 4'-methoxybenzoylamino)-2,4-dibutoxy, and 4-(4'-trimercapto)-2,5-dimethoxy.

Other examples of diazo compounds which can be used in the present invention include diazoamino compounds. Diazoamino compounds can be obtained by coupling diazo groups with dicyanodiamide, sarcosine, methyltaurine, N-ethylanthranic acid-5-sulfonic acid, monoethanolamine, diethanolamine, guanidine, etc.

These diazo compounds are further described in JPA-2-136286.

Specific examples of the coupling component which undergoes coupling with the diazo compound (diazonium salt) used in the present invention to form a dye include anilide 2-hydroxy-3-naphthoate, resorcin, and compounds as described in JP-A-62-146678.

Furthermore, two or more of these coupling components may be used in combination to obtain an image of any tone. Since the coupling reaction of these diazo compounds with coupling components can easily occur in a basic atmosphere, a basic substance may be incorporated in the layer.

As such a basic substance, there may be used a slightly water-soluble or water-insoluble basic substance or a substance which produces an alkali upon heating. Examples of these substances include nitrogen-containing compounds such as inorganic and organic ammonium salts, organic amines, amides, urea and thiourea and derivatives thereof, thiazoles, pyrroles, pyrimidines, piperadines, guanidines, indoles, imidazoles, imidazolines, triazoles, morpholines, piperidines, amidines, formazines, and pyridines. Specific examples of these compounds are described in JP-A-61-291183.

Two or more of these basic substances may be used in combination.

The electron-donating dye precursor to be used in the present invention is not specifically limited. As such an electron-donating dye precursor, there can be used a normally substantially colorless compound containing a partial skeleton such as a lactone, lactam, saltone, spiropyran, ester or amide which donates electrons or accepts a proton such as an acid to develop color but undergoes ring opening or cleavage of the partial skeleton when brought into contact with a developer. Specific examples of such an electron-donating dye precursor include crystal violet lactone, benzoyl leucomethylene blue, malachite green lactone, rhodamine B lactam, and 1,3,3-trimethyl-6'-ethyl-8'-butoxyindolinobenzospiropyran.

In the present invention, if heat-sensitive layers having different color hues are laminated to form a multicolor heat-sensitive recording material, yellow color precursors, cyan color precursors and magenta color precursors are used. These precursors are further described in JP-A-61-24495.

As developers for these couplers, there may be used acidic substances such as a phenolic compound, organic acid or metallic salt thereof, and oxybenzoic ester. Developers having a melting point of about 50° C. to about 250° C. can be preferably used. In particular, slightly water-soluble phenol or organic acids having a melting point of about 60° C. to about 200° C. can be preferably used. Specific examples of these compounds are described in JP-A-61-291183.

As an infrared-absorbing dye to be used in the present invention, there may be preferably used a dye which absorbs little visible light but significantly absorbs light of infrared range. The solubility of the infrared-absorbing dye in water is preferably in the range of about 0.001 to 5 wt %, more preferably 0.01 to 1 wt %. If this value is too high, the stability of the emulsion becomes insufficient. On the contrary, if this value is too low, the compatibility with a developer or a coupler becomes insufficient, making it difficult to form a homogenous emulsion.

The amount of the infrared-absorbing dye to be used is preferably in the range of about 0.01 to 10 wt % per the heat-sensitive color forming layer and the transmitted light absorption of a wavelength of a laser beam to be used for recording is preferably in the range of about 0.5 to 2.0. If the amount of the infrared-absorbing dye is too large, the contact between two coloring components during heating is inhibited and the heat developed at the light-absorbing time becomes heterogeneous, resulting in a blacking due to the oxidation of the surface irradiated with a laser beam. On the contrary, if the amount of the infrared-absorbing dye is too small, there is caused a problem that a laser beam is not effectively utilized for the heat generation.

Examples of such a dye include cyanine dyes, phthalocyanine dyes, pyrylium dye, thiopyrylium dye, azulenium dye, aquarylium dye, Ni metal complex dye, Cr metal complex dye, naphthoquinone dye, anthraquinone dye, indophenol dye, indoaniline dye, triphenylmethane dye, triallylmethane dye, aminium dye, diimmonium dye, and nitroso compound.

Preferred among these dyes are dyes which absorb light in the near infrared range, particularly from 700 nm to 900 nm, at a high efficiency. Specific examples of these dyes include those represented by the following general formulae:

(1) Cyanine dye:

$$(CH_3)_2N-(CH=CH)_5-CH=^{+}N(CH_3)_2ClO_4^{-}$$

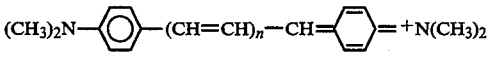

wherein n represents an integer 2 or 3.

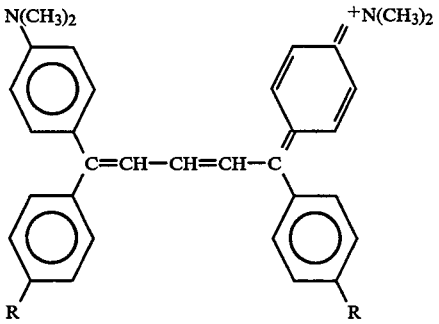

wherein R represents a hydrogen atom or $-N(CH_3)_2$.

$$A-(CH=CH)_n-CH=B$$

wherein A represents any of the groups represented by the following general formulae:

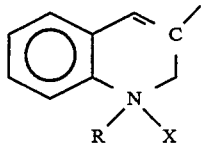

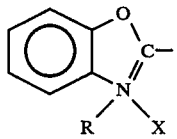

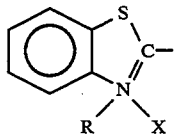

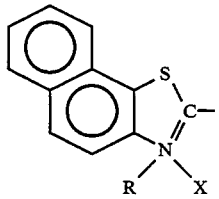

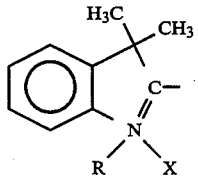

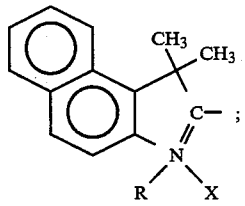

and B represents any of the groups represented by the following general formulae:

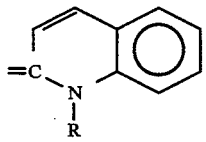

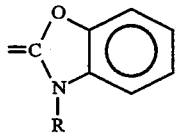

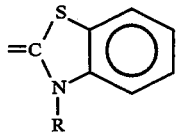

-continued

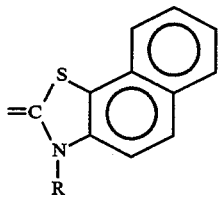

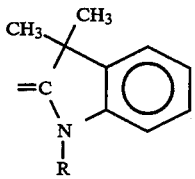

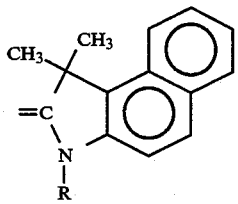

In the last 12 general formulae, R represents an alkyl group; X represents a paired ion; and n represents an integer 0 to 3. In the benzene ring or naphthalene ring, a chlorine atom, alkyl group, alkoxy group or aryl group may be optionally present.

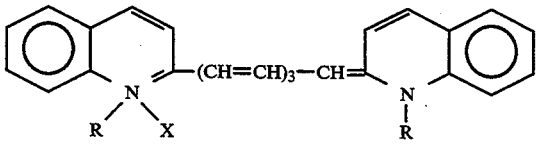

wherein R represents an alkyl group; and X represents a halogen atom.

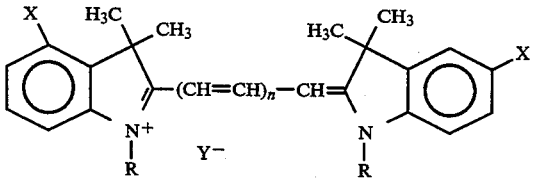

wherein R represents a substituted or unsubstituted alkyl group, alkoxy group or alkenyl group; X represents a hydogen atom or halogen atom; Y represents a halogen atom, perchlorate, substituted or unsubstituted benzene sulfonate, paratoluene sulfonate, methyl sulfate, ethyl sulfate, benzene carboxylate, methyl carboxylate, or trifluoromethyl carboxylate; and n represents an integer 0 to3.

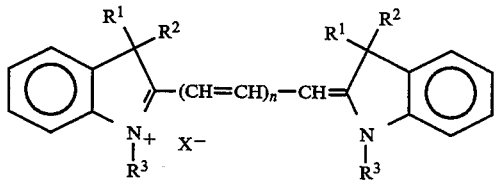

wherein $R^1$, $R^2$ and $R^3$ each represents a substituted or unsubstituted alkyl group and may be the same or different; $X^-$ represents a perhalogenic acid ion, toluenesulfonic acid ion or alkylsulfuric acid ion; and n represents an integer 0 to 3. A halogen atom is present in at least one of the 4-, 5-, 6- and 7-positions of the indolenine ring, and if necessary, another halogen atom may be further present in the other positions. If necessary, the benzene ring may be substituted by an alkyl group, alkoxy group, hydroxy group, allyl group or alkalicarbonyl group.

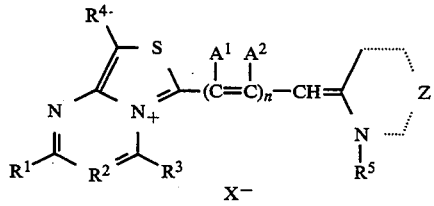

wherein $A^1$ and $A^2$ each represents a hydrogen atom or substituent; Z represents an atomic group required for the formation of a 5-membered heterocyclic group; $R^1$ to $R^4$ each represents a hydrogen atom or substituent; $R^5$ may represent a substituent or may form a 6-membered heterocyclic group together with Z; $X^-$ represents an anion; and n represents an integer 0 to 2.

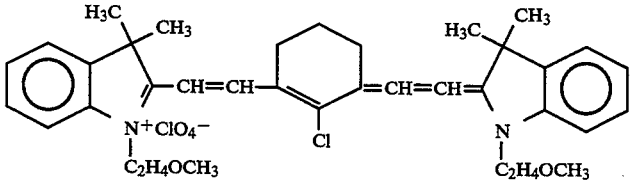

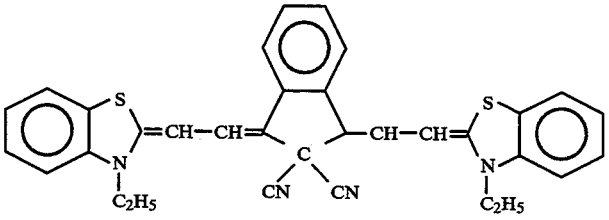

Chemical formula: $\Phi-L=\Psi\ (X^-)_m$ wherein $\Phi$ and $\Psi$ each represents an indole ring residue, thiazole ring residue, oxazole ring residue, selenazole ring residue, imidazole ring residue or pyridine ring residue to which an aromatic ring residue is condensed; L represents a linking group for forming monocarbocyanine, dicarbocyanine, tricarbocyanine or tetracarbocyanine; and m represents an integer 0 or 1.

(2) Squalium dye:

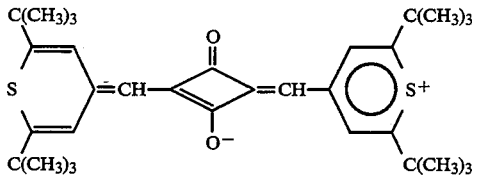

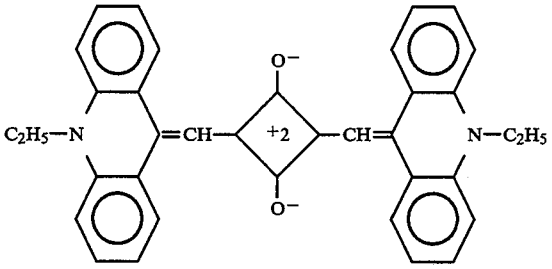

(3) Azulenium dye:

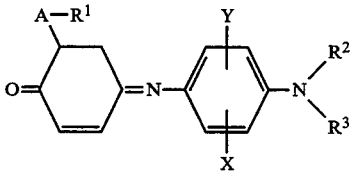

wherein at least one of the combinations of $R^1$ and $R^2$, $R^2$ and $R^3$, $R^3$ and $R^4$, $R^4$ and $R^5$, $R^5$ and $R^6$, and $R^6$ and $R^7$ forms a substituted or unsubstituted heterocyclic ring or aliphatic ring, with the proviso that R1, R2, R3, R4, R5, R6 and R7, when not involved in the formation of the ring, each represents a hydrogen atom, halogen atom or monovalent organic residue, or at least one of the combinations of $R^1$ and $R^2$, $R^2$ and $R^3$, $R^3$ and $R^4$, $R^4$ and $R^5$, $R^5$ and $R^6$, and $R^6$ and $R^7$ forms a substituted or unsubstituted aromatic ring; A represents a divalent organic residue bonded to the nucleus via a double bond; and $Z^-$ represents an anion residue. At least one of carbon atoms which form the azulene ring is replaced by a nitrogen atom to form an azazulene ring.

(4) Indophenol dye:

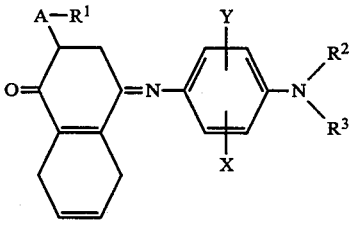

wherein X and Y each represents a hydrogen atom, alkyl group, acylamino group, alkoxy group or halogen atom; $R^1$, $R^2$ and $R^3$ each represents a hydrogen atom or $C_{1-20}$ substituted or unsubstituted alkyl group, aryl group, heterocyclic group or cyclohexyl group; and A represents —NHCO— or —CONH—.

(5) Metal complex dye:

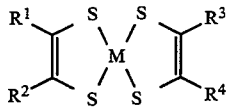

wherein $R^1$ to $R^4$ each represents an alkyl group or aryl group; and M represents a divalent transition metal atom.

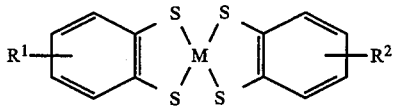

wherein $R^1$ and $R^2$ each represents an alkyl group or halogen atom; and M represents a divalent transition metal atom.

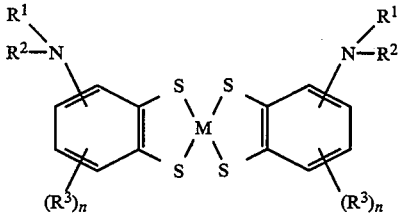

wherein $R^1$ and $R^2$ each represents a substituted or unsubstituted alkyl group or aryl group; $R^3$ represents an alkyl group, halogen atom or —N($R^4$)—$R^5$ group (in which $R^4$ and $R^5$ each represents a substituted or unsubstituted alkyl group or aryl group); M represents a transition metal atom; and n represents an integer 0 to 3.

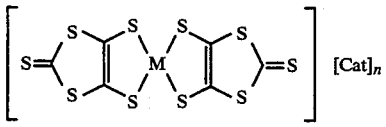

wherein [Cat] represents a cation which neutralizes a complex salt; M represents Ni, Cu, Co, Pd or Pt; and n represents an integer 1 or 2.

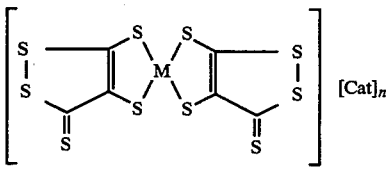

wherein [Cat] represents a cation which neutralizes a complex salt; M represents Ni, Cu, Co, Pd or Pt; and n represents an integer 1 or 2.

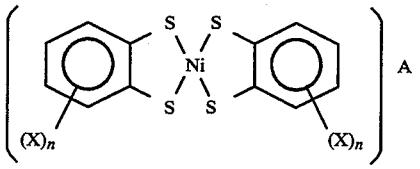

wherein X represents a hydrogen atom, bromine atom or methyl group; n represents an integer 1 to 4; and A represents a quaternary ammonium group.

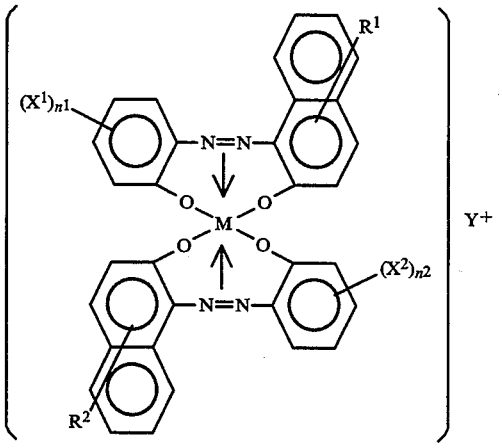

wherein $X^1$ and $X^2$ each represents a nitro group and/or halogen atom; $n^1$ and $n^2$ each represents an integer 1 to 3; $R^1$ and $R^2$ each represents an amino group, monoalkylamino group, dialkylamino group, acetylamino group or benzoylamino group (including a substituted benzoylamino group); $X^1$ and $X^2$, $n^1$ and $n^2$, and $R^1$ and $R^2$ may be the same or different; M represents a Cr or Co atom; Y represents a hydrogen atom, sodium atom, potassium atom, ammonium group, aliphatic ammonium group (including a substituted aliphatic ammonium group) or alicyclic ammonium group.

(6) Naphthoquinone and anthraquinone dyes:

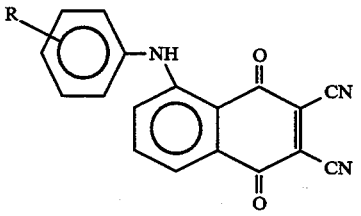

wherein R represents a hydrogen atom, alkyl group, allyl group, amino group or substituted amino group.

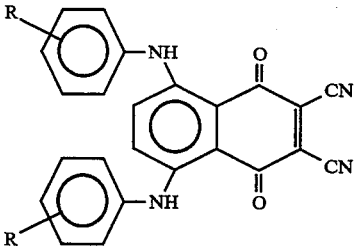

wherein R represents a hydrogen atom, alkyl group allyl group, amino group or substituted amino group.

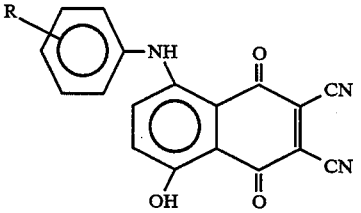

wherein R represents a hydrogen atom, alkyl group, allyl group or substituted amino group.

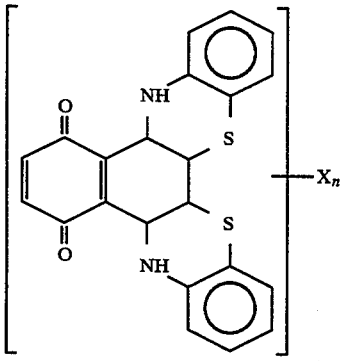

wherein X represents a halogen atom; and n represents an integer 0 to 10.

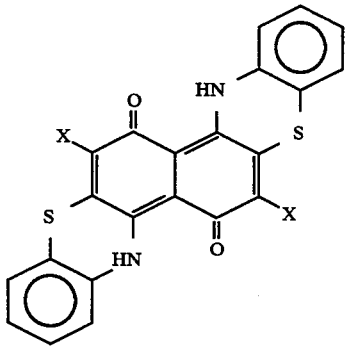

wherein X represents a halogen atom.

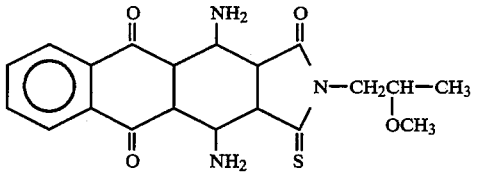

Among these dyes, those which can be particularly preferably used for the heat-sensitive recording material of the present invention are cyanine dyes. One or more of these dyes can be used in combination.

In the present invention, when the infrared-absorbing dye, which is rendered colorless by absorbing light in a specific wavelength, is used, the light of the specific wavelength range may be selected not only from the visible range but also from ranges including the infrared range, ultraviolet range, X-ray range and electron ray range, and a range in which the light-absorbing decomposable dye as described below absorbs light and is rendered colorless.

Colored dyes to be used in the present invention which absorb light of a specific wavelength range to be rendered colorless (hereinafter referred to as "light-absorbing decomposable dyes") are not specifically limited and can be selected from known light-absorbing decomposable substances which specifically absorb a laser beam of a specific wavelength to convert the energy of the laser beam to heat energy but are rendered colorless upon irradiation with light of a specific wavelength.

Examples of light-absorbing decomposable dyes which can be used in the present invention include ionic dye-paired ion compounds (as disclosed in JP-A-62-150242, 1-152450), cationic dye-borate anion complexes (as disclosed in JP-A-62-143044), 3-position-substituted coumarine compounds (as disclosed in JP-A-61-114234), and bis(diiminosuccinonitrilo)metal complexes (as disclosed in JP-B-3-10087).

Preferred among these light-absorbing decomposable dyes are ionic dye-paired ion compounds. Particularly preferred among these light-absorbing decomposable dyes are cationic dye-borate anion complexes.

The above-mentioned ionic dye-paired ion compound is a compound consisting of an ionic dye ionically bonded to a reactive paired ion. This compound itself is capable of absorbing light and thus is colored. When this compound absorbs light of a specific wavelength upon irradiation to excite the ionic dye, the paired ion donates electrons to the ionic dye or receives electrons from the ionic dye thus excited to produce free groups to become colorless. When such a compound is incorporated in a heat-sensitive layer, the background of the recording material is colored. However, when the recording material is irradiated with light of a specific wavelength range, the background of the recording material can be rendered colorless or white.

In the present invention, preferred among these ionic dye-paired ion compounds are cationic dye-paired ion compounds such as cationic dye-borate anion complexes represented by the following general formula:

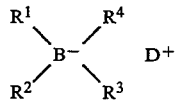

wherein $D^+$ represents a cationic dye such as cyanine, carbocyanine, hemicyanine, rhodamine and azomethane; and $R^1$, $R^2$, $R^3$ and $R^4$ each represents an alkyl group, aryl group, alkaryl group, allyl group, aralkyl group, alkenyl group, alkenylalkinyl group, alicyclic group or saturated or unsaturated heterocyclic group and may be the same or different.

Specific examples of such a compound are further described in JP-A-62-150242.

In the present invention, cationic dye-borate anion complex compounds having a maximum absorption wavelength of 740 nm represented by the following general formula:

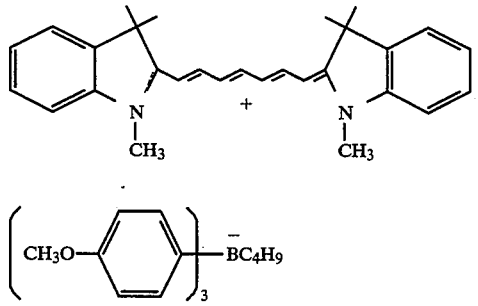

are particularly preferred.

Examples of anionic dye-paired ion compounds include anionic dye-iodonium ion compounds represented by the following general formula:

$$[R^5-\overset{\oplus}{I}-R^6]_nD^{-n}$$

wherein $D^-$ represents an anionic dye; $R^5$ and $R^6$ each represents a group consisting of an aromatic nucleus such as phenyl group and naphthyl group and may be the same or different; and n represents an integer of 1 or 2. Specific examples of such compounds are further described in JP-A-62-150242.

In the present invention, compounds having a maximum absorption wavelength of 570 nm represented by the following general formula:

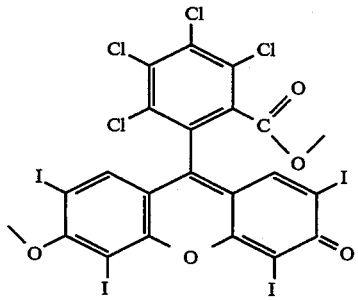

-continued

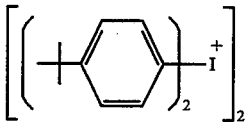

are particularly preferred.

The above-mentioned 3-position-substituted coumarine compound which can be used in the present invention is capable of absorbing light in the wavelength range of 390 to 500 nm.

Specific examples of such a 3-position-substituted coumarine compound are further described in JP-A-61-114234.

Bis(diiminosuccinonitrilo)metal complexes are compounds represented by the following general formula:

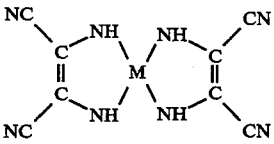

wherein M represents nickel, palladium, platinum or cobalt.

The above-mentioned bis (diiminosuccinonitrilo) metal complexes exhibit a maximum absorption in the wavelength range of 650 to 1,150 nm.

Specific examples of such bis(diiminosuccinonitrilo)-metal complexes and synthesis methods thereof are further described in JP-B-3-1008.

The preparation of the microcapsules to be used in the present invention can be accomplished by any of an interfacial polymerization process, an internal polymerization process and an external polymerization process. In particular, a process may be preferably used which comprises emulsifying core substances containing coloring components in an aqueous solution of a water-soluble high molecular weight compound, and then forming the wall of the high molecular weight substance around the oil drops.

The reactants for the formation of the high molecular weight substance may be incorporated in the interior and/or exterior of the oil drops. Specific examples of such a high molecular weight substance include polyurethane, polyurea, polyamide, polyester, polycarbonate, urea-formaldehyde resin, melamine resin, polystyrene, styrene-methacrylate copolymer, and styrene-acrylate copolymer. Preferred among these high molecular weight substances are polyurethane, polyurea, polyamide, polyester, and polycarbonate. Particularly preferred among these high molecular weight substances are polyurethane and polyurea. Two or more of these high molecular weight substances may be used in combination.

Specific examples of the above mentioned water-soluble high molecular weight compounds include gelatin, polyvinyl pyrrolidone, and polyvinyl alcohol.

For example, if polyurea is used for the wall of the microcapsules, a polyisocyanate such as diisocyanate, triisocyanate, tetraisocyanate and polyisocyanate prepolymer and a polyamine such as diamine, triamine and tetramine, prepolymer containing two or more amino groups, piperadine or derivative thereof or polyol may be easily allowed to undergo interfacial polymerization in an aqueous solvent to form the wall of the microcapsules.

Furthermore, the preparation of a composite wall made of polyurea and polyamide or a composite wall made of polyurea and polyamide can be accomplished by adjusting the pH value of an emulsion medium of polyisocyanate and acid chloride or polyamine and polyol as the reaction solution, and then heating the emulsion medium. The method for the preparation of such a composite wall made of polyurea and polyamide is further described in JP-A-58-66948.

Such a solid sensitizer can be selected from compounds ranging from plasticizers for polymers to be used as the wall of the microcapsules to substances which exhibit a melting point of about 50° C. or higher, preferably 120° C. or lower, but which stay solid at normal temperature. For example, if the wall material consists of polyurea and polyurethane, hydroxyl compounds, carbamic ester compounds, aromatic alkoxy compounds, organic sulfonamide compounds, aliphatic amide compounds, arylamide compounds, etc. can be preferably used.

In the present invention, if a diazo compound is used as a color former, a coloring aid can be used.

The coloring aid which can be used in the present invention is a substance which raises the color density or reduces the lowest coloring temperature upon printing by laser heating. The coloring aid is adapted to reduce the melting point of the coloring components or basic substances or the softening point of the wall of the microcapsules to provide a condition such that the coloring component A and the coloring component B can easily react with each other.

Examples of such a coloring aid include phenol compounds, alcohol compounds, amide compounds, and sulfonamide compounds. Specific examples of these compounds include p-tert-octylphenol, p-benzyloxyphenol, phenyl p-oxybenzoate, benzyl carbanylate, phenethyl carbanylate, hydroquinone dihydroxy ethyl ether, xylylene diol, amide N-hydroxyethyl-methanesulfonate, and amide N-phenyl-methanesulfonate. These compounds may be incorporated in the core substance or incorporated in the microcapsules in the form of emulsion dispersion.

In the present invention, if only one of the two coloring components is microcapsulized, the diazo compound or electron-donating dye precursor is preferably microcapsulized. The coupler or developer is used in the form of a dispersion obtained by the emulsion dispersion of a mixture of a solution of the coupler or developer in an organic solvent slightly soluble or insoluble in water with an aqueous phase containing as a protective colloid a water-soluble high molecular weight compound containing a surface active agent. In this case, the heat-sensitive layer can be rendered transparent.

In the present invention, if the heat-sensitive layer is rendered transparent to be used for OHP (Over Head Projector) or a number of these heat-sensitive layers are laminated to make a multi-color recording material, the above-mentioned color former, developer and light-absorbing decomposable dye which are not microcapsulized may be preferably used in the form of an emulsion dispersion obtained by the emulsion dispersion of a mixture of a solution of these compounds in an organic solvent slightly soluble or insoluble in water with an aqueous phase containing as a protective colloid a water-soluble high molecular weight compound containing a surface active agent.

In particular, in order to improve the preservability of the recording material, the color former is preferably microcapsulized while the developer is preferably emulsion-dispersed. The light-absorbing decomposable dye is emulsion-dispersed with the developer.

The organic solvent to be used in this case can be properly selected from high boiling oils. Preferred examples of such high boiling oils include esters, dimethyl naphthalene, diethyl naphthalene, diisopropyl naphthalene, dimethyl biphenyl, diethyl biphenyl, diisopropyl biphenyl, diisobutyl biphenyl, 1-methyl-1-dimethylphenyl-1-phenylmethane, 1-ethyl-1-dimethylphenyl-1-phenylmethane, 1-propyl-1-dimethylphenyl-1-phenylmethane, triallylmethane (e.g., tritoluylmethane, toluyldiphenyl methane), terphenyl compounds (e.g., terphenyl), alkyl compounds, alkylated diphenyl ether (e.g., propyl diphenyl ether), hydrogenated terphenyl (e.g., hexahydroterphenyl), and diphenyl ether.

Among these high boiling oils, esters may be particularly preferably used in view of emulsion stability of the emulsion dispersion.

Examples of such esters include phosphoric esters (e.g., phosphoric triphenyl, phosphoric tricresyl, phosphoric butyl, phosphoric octyl, phosphoric cresyl diphenyl), phthalic esters (e.g., phthalic dibutyl, 2-ethylhexyl phthalate, phthalic ethyl, phthalic octyl, phthalic butylbenzyl), tetrahydrophthalic dioctyl, benzoic esters (e.g., benzoic ethyl, benzoic propyl, benzoic butyl, benzoic isopentyl, benzoic benzyl), abietic esters (e.g., abietic ethyl, abietic benzyl), adipic dioctyl, succinic isodecyl, azelaic dioctyl, oxalic esters (e.g., oxalic dibutyl, oxalic dipentyl), malonic diethyl, maleic esters (e.g., maleic dimethyl, maleic diethyl, maleic dibutyl), citric tributyl, sorbic esters (e.g., sorbic methyl, sorbic ethyl, sorbic butyl), sebacic esters (e.g., sebacic dibutyl, sebacic dioctyl), ethylene glycol esters (e.g., formic monoester, formic diester, butyric monoester, butyric diester, lauricmonoester, lauric diester, palmitic monoester, palmitic diester, stearic monoester, stearic diester, oleic monoester, oleic diester), triacetin, diethyl carbonate, diphenyl carbonate, ethylene carbonate, propylene carbonate, and boric esters (e.g., tributyl borate, tripentyl borate). Among these compounds, phosphoric tricresyl can be preferably used singly or in combination with other esters to provide a particularly excellent emulsion dispersion stability of the developer.

The above-mentioned oils may be used in combination thereof or in combination with other oils.

In the present invention, an auxiliary solvent may be added to the above-mentioned organic solvent as a solution aid having a lower boiling point. Particularly preferred examples of such an auxiliary solvent include ethyl acetate, isopropyl acetate, butyl acetate, and methylene chloride.

The water-soluble high molecular weight compound to be incorporated as a protective colloid in an aqueous phase to be mixed with an oil phase containing these components can be properly selected from known anionic high molecular weight compounds, nonionic high molecular weight compounds, and amphoteric high molecular weight compounds. Polyvinyl alcohol, gelatin, cellulose derivatives, etc. may be preferably used.

As the surface active agent to be incorporated in the aqueous phase, there can be properly selected a compound which does not act on the above-mentioned protective colloid and causes no precipitation or cohesion from anionic or nonionic amphoteric surface active agents. Preferred examples of surface active agents include sodium alkylbenzenesulfonate, sodium alkylsulfate, dioctylsodium sulfosuccinate, and polyalkylene glycol (e.g., polyoxyethylene nonyl phenyl ether).

The emulsion dispersion of the present invention can be easily obtained by dispersing an oil phase containing the above-mentioned components and an aqueous phase containing a protective colloid and a surface active agent in admixture by a means commonly used in fine emulsification, such as high speed agitation or ultrasonic dispersion.

The ratio of the oil phase to the aqueous phase (weight of oil phase/weight of aqueous phase) is preferably in the range of 0.02 to 0.6, particularly 0.1 to 0.4. If this value falls below 0.02, there is too much aqueous phase, making the system too dilute and making it impossible to obtain sufficient color developability. On the contrary, if this value exceeds 0.6, the viscosity of the solution becomes too high, causing poor handleability or reduction in the stability of the coating solution.

The heat-sensitive layer may optionally comprise a pigment, wax, film hardener, etc. incorporated therein. The coating of the heat-sensitive layer solution thus prepared (e.g., capsule solution, emulsion dispersion) on a support can be accomplished by a coating method such as blade coating method, air knife coating method, gravure coating method, roll coating method, spray coating method, dip coating method and bar coating method.

In this case, in order to stably or uniformly coat the heat-sensitive layer solution and keep the resulting coat film sufficiently strong, as a binder there can be coated in the present invention methyl cellulose, carboxymethyl cellulose, hydroxyethyl cellulose, starch, gelatin, polyvinyl alcohol, carboxy-modified polyvinyl alcohol, polyacrylamide, polystyrene and copolymers thereof, polyester and copolymers thereof, polyethylene and copolymers thereof, epoxy resin, acrylate and methacrylate resin and copolymers thereof, polyurethane resin, polyamide resin, or the like, along with the microcapsules.

The heat-sensitive layer may be preferably coated in such a manner that the total amount of the coloring components and infrared-absorbing dyes reaches about 0.1 to 10 $g/m^2$ and the thickness thereof reaches about 1 to 10 $\mu m$.

In order to prevent the adhesion to the heat-sensitive layer that otherwise causes physical transfer of dyes, a lubricant such as wax can be coated. For a similar purpose, a protective layer can be coated.

The support to be used in the present invention may be transparent or opaque. As the transparent support, there may be preferably used a support material which exhibits a high transparency, no absorption of the wavelength of a laser beam radiated, and a dimensional stability sufficient to cause no deformation under heating upon irradiation with a laser beam. In this case, a laser beam can be radiated through the transparent support to effect recording. The thickness of the support is in the range of about 10 to 200 $\mu m$.

Examples of such a transparent support include polyester film such as polyethylene terephthalate film and polybutylene terephthalate film, cellulose derivative film such as cellulose triacetate film, polyolefin film such as polystyrene film, polypropylene film and polyethylene film, polyimide film, polyvinyl chloride film, polyvinylidene chloride film, polyacryl film, and polycarbonate film. These films may be used singly or in laminated form.

On the other hand, examples of the opaque support for the recording material include paper, synthetic paper, aluminum-deposited base, and transparent support coated with a pigment or the like. In this case, in order to allow a laser beam to be radiated on the heat-sensitive layer side so that it can be efficiently absorbed by the heat-sensitive layer, as the opaque support for the recording material there may be preferably used a material which exhibits a high reflectivity to a laser beam.

As the support to be used in the present invention, there may be particularly preferably used a polyester film which has been rendered heat-resistant or antistatic.

In the present invention, an undercoating layer may be preferably provided on the support before the coating of the heat-sensitive layer containing microcapsules and other additives for the purpose of preventing the entire heat-sensitive layer from being peeled off the support.

As material for the undercoating layer, there can be used an acrylic ester copolymer, polyvinylidene chloride, SBR, aqueous polyester, or the like. The thickness of the film is preferably in the range of about 0.1 to0.5$\mu$m.

The undercoating layer made of these compositions may be coated on the support by the same coating method as used for the above-mentioned heat-sensitive layer. The amount of the undercoating layer to be coated is preferably in the range of about 1 to 20 g/m$^2$, particularly 3 to 10 g/m$^2$.

In the present invention, in order to prevent the reduction in the apparent transparency due to the scattering of light on the surface of the heat-sensitive layer, a protective layer may be preferably provided on the heat-sensitive layer by a known method.

The protective layer is further described in, e.g., "Kami Parupu Gijustu Taimusu (Paper Pulp Techincal Times)", September 1985, pp. 2–4, and JP-A-63-318546.

In order to improve the transparency of the protective layer, a combination of silica-modified polyvinyl alcohol and colloidal silica is particularly preferably used.

In the present invention, a protective layer mainly comprising a silicone resin may be provided along with or instead of the above-mentioned conventional protective layer. With this structure, the water resistance of the heat-sensitive recording material can be improved without impairing the transparency of the heat-sensitive layer.

The protective layer may comprise waxes, metallic soaps, etc. for the purpose of improving the adaptability to the thermal head upon heat typing, the water resistance of the protective layer, etc. The amount of these additives to be incorporated is preferably in the range of about 0.2 to 7 g/m$^2$.

The laser to be used in the present invention is not specifically limited. As such a laser there can be selected from known lasers a laser which emits a laser beam of a wavelength that can be efficiently absorbed by the light-absorbing decomposable dye or a laser beam of a wavelength in the infrared range. Specific examles of such a laser include a helium-neon laser, argon laser, carbonic acid gas laser, YAG laser, and semiconductor laser, (GaAs junction laser). When the heat-sensitive layer in the recording material of the present invention has been obtained by the coating of a coating solution containing a developer and an infrared-absorbing dye in the form of an emulsion, it exhibits a high transparency and reflects little of the laser beam. Further, since the heat-sensitive layer comprises an infrared-absorbing dye which absorbs little visible light but absorbs infrared rays particularly, the recording material is little colored on its background while exhibiting a high efficiency of absorbing an infrared laser beam. Accordingly, a laser beam can be efficiently absorbed by the portion of the heat-sensitive layer irradiated with the laser beam. Therefore, the basic dye precursor contained in the microcapsules incorporated in the heat-sensitive layer undergoes color development reaction with the developer outside the microcapsules to form an excellent image.

Moreover, if the coupling component or developer is used in the form of an emulsion, the transparency of the heat-sensitive layer can be improved.

Since the infrared-absorbing dye incorporated in the heat-sensitive layer in the recording material of the present invention absorbs little visible light but absorbs infrared rays particularly, the recording material is little colored on its background.

Since the infrared-absorbing dye exhibits a high efficiency of absorbing an infrared laser beam, a laser beam can be efficiently absorbed by the portion of the recording layer irradiated with the laser beam. Accordingly, when heated, the wall of the microcapsules can improve its permeability, allowing the diazo compound contained in the microcapsules incorporated in the recording layer and the coupling components outside the microcapsules to react with each other to form an image. Then, when the recording layer is entirely irradiated with light of the photo-decomposition wavelength of the diazo compound, the portion of the recording layer which has not been irradiated with laser beam is light-fixed and can no longer form any image thereon.

The recording material of the present invention comprises an infrared-absorbing dye and thus is colored on its background, making a nearly white recording material which enables refined recording with a high contrast. Furthermore, since the color development between the diazo compound and the coupling component is used, the heat-sensitive recording material of the present invention can provide non-contact heat-sensitive recording with an infrared laser beam and exhibits an excellent preservability after printing.

Moreover, by selecting an infrared-absorbing dye which exhibits no absorption in the visible range, the coloring of the background of the recording material can be prevented.

Furthermore, the recording material of the present invention in which a heat-sensitive layer has been formed by the coating of a coating solution containing a developer and an infrared-absorbing dye as emulsion exhibits a high transparency and thus reflects little of a laser beam. Moreover, since the heat-sensitive layer contains an infrared-absorbing dye which particularly absorbs infrared rays, it exhibits a high efficiency of absorbing an infrared laser beam and can provide a high speed and quality non-contact heat-sensitive recording.

If the support for the heat-sensitive recording material is transparent, the image recording on the recording material of the present invention can be effected by imagewise radiating a laser beam from the heat-sensitive layer side or support side to record an image, and then exposing the entire surface of the heat-sensitive layer and/or support side to light of a specific wavelength.

By this entire exposure, the light-absorbing decomposable dye contained in the heat-sensitive layer can be rendered colorless, providing a sharp image.

If the support for the heat-sensitive recording material is opaque, a highly refined reflected image with a white background can be obtained by imagewise radiating the heat-sensitive recording material with a laser beam from the heat-sensitive layer side to record an image, and then exposing the entire surface of the heat-sensitive layer side to light.

If a diazo compound is used as a developer, light capable of decomposing the diazo compound may be contained in the light of a specific wavelength for the entire exposure, or various types of light may be simultaneously radiated to simultaneously render the dye colorless and fix the image.

By using a combination of color former and developers which develop different color hues and laminating heat-sensitive layers containing light-absorbing decomposable dyes which absorb laser beams having different wavelengths, a multi-color image can be easily obtained.

The heat-sensitive layer in the recording material of the present invention contains a light-absorbing decomposable dye which exhibits a high efficiency of absorbing a laser beam and is rendered colorless upon absorption of light of a specific wavelength. Therefore, even if the heat sensitivity of the recording material is drastically improved by increasing the content of the light-absorbing decomposable dye, a sharp image can be obtained. Accordingly, by using the recording material of the present invention, a high speed laser recording can be effected, The resulting image exhibits an excellent quality.

The present invention will be further described in the following examples, but the present invention should not be construed as being limited thereto. All parts, percents, ratios, and the like are by weight unless otherwise indicated.

EXAMPLE 1

Preparation of Capsule Solution 50 parts by weight of a compound of the following general formula:

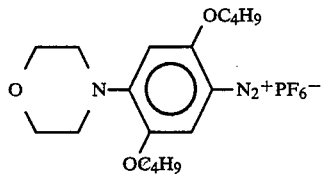

was uniformly mixed with 150 g of methylene chloride, 50 parts by weight of tricresyl phosphate, 150 parts by weight of trimethylol propane trimethacrylate, and 200 parts by weight of a 75 wt % ethyl acetate solution of a 3:1 adduct of m-xylylene diisocyanate and trimethylol propane (Takenate D110N; trade name of a product of Takeda Chemical Industries, Ltd.) to prepare an oil phase solution.

On the other hand, 600 parts by weight of a 7 wt % polyvinyl alcohol (PVA217E; saponification degree: 88 to 89%; polymerization degree: 1,700; trade name of a polyvinyl alcohol produced by Kuraray Co., Ltd.) were prepared in the form of an aqueous solution of a water-soluble high molecular weight compound.

The aqueous solution of the high molecular weight compound was charged into a 5 l stainless steel pot with a hot bath equipped with a dissolver. The above-mentioned oil phase solution was added to the system while stirring by the dissolver. The system was subjected to emulsion dispersion in such a manner that the average grain diameter of the emulsion reached about 1.5 μm while observed under a microscope. After the completion of dispersion, the agitation was slowed down, and42° C. hot water was passed to the hot bath to keep the temperature in the pot at 40° C. The system was allowed to undergo a capsulization reaction for 3 hours. To the resulting solution was added 25 ml of an ion-exchange resin MB-3 (trade name of a product of Organo K.K.) with stirring. The reaction system was then filtered to obtain a capsule solution.

Preparation of emulsion dispersion

Solution 1:

4 wt % Aqueous solution of 140 parts by weight polyvinyl alcohol

Solution 2:

The components set forth in Table 1 were mixed to prepare Solution 2.

TABLE 1

| | |
|---|---|
| Coupler of the general formula: | 1.4 parts by weight |
| 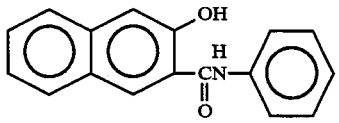 | |
| Coupler of the general formula: | 1.4 parts by weight |
| 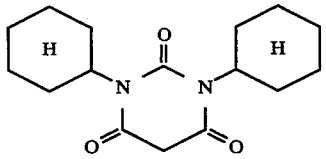 | |
| Triphenyl guanidine (base) | 6 parts by weight |
| Colorability improver of the general formula: | 14 parts by weight |

TABLE 1-continued

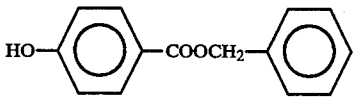

| | |
|---|---|
| Infrared-absorbing dye of the general formula: | 0.5 part by weight |

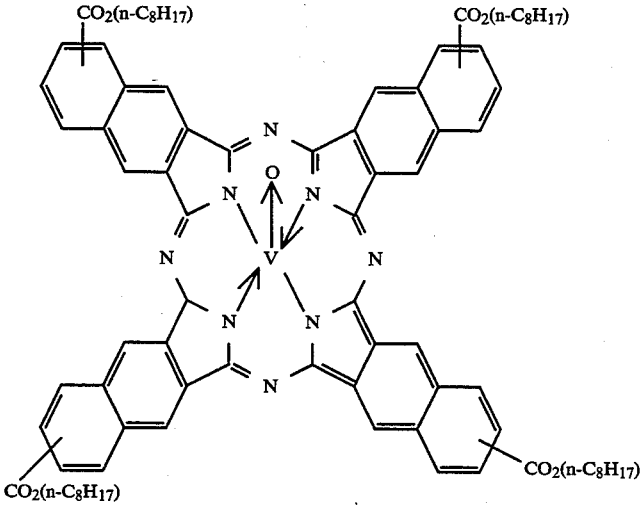

| | |
|---|---|
| Tricresyl phosphate | 10 parts by weight |
| Ethyl acetate | 20 parts by weight |

Solution 2 was added to Solution 1 in admixture. The mixture was then subjected to emulsion dispersion at a temperature of 20° C. in such a manner that the average grain diameter of the emulsion grains reached 3 μm to obtain an emulsion dispersion.

Preparation of Heat-Sensitive Recording Material 4.9 parts by weight of the above-mentioned capsule solution, 3.7 parts by weight of the above-mentioned emulsion dispersion, and 0.2 parts by weight of a 5 wt % aqueous solution of hydroquinone were mixed with stirring, coated on a 75 μm thick transparent polyethylene terephthalate (PET) support in such a manner that the solid content reached 15 g/m$^2$, and then dried to form a heat-sensitive layer thereon. Further, onto the heat-sensitive layer was coated a mixture of the composition set forth in Table 2 to a thickness of 2 μm to form a protective layer thereon. Thus, a transparent heat-sensitive recording material of the present invention was prepared.

TABLE 2

| Composition of protective layer | |
|---|---|
| Silica-modified polyvinyl alcohol (PVA R2105; trade name of a product of Kuraray Co., Ltd.) | 1 part by weight in terms of solid content |
| Colloidal silica (Snowtex 30; produced by Nissan Chemical Industries, Ltd.) | 1.5 parts by weight in terms of solid content |
| Zinc stearate (Hydrin Z-7, produced by Chukyo Yushi K.K.) | 0.02 part by weight in terms of solid content |
| Paraffin wax (Hydrin P-7; produced by Chukyo Yushi K.K.) | 0.02 part by weight in terms of solid content |

The resulting recording material was then imagewise irradiated with a semiconductor infrared laser beam (GaAs junction laser) of a wavelength of 780 nm from the heat-sensitive layer side to obtain a black image. The output of the laser beam was adjusted such that an energy of 40 mJ/mm$^2$ was obtained in 1 m sec. on the surface of the heat-sensitive layer in the recording material.

The recording material was then entirely exposed to light and light-fixed by means of Ricopy Super Dry 100 (produced by Ricoh Company, Ltd.). The resulting recorded image was measured for transmission density of visual density by means of a Macbeth reflection densitometer. The result was 1.22.

When the recorded image was projected through an overhead projector, a sharp black image with no stain on its background was displayed.

COMPARATIVE EXAMPLE 1

A recording material was prepared in the same manner as in Example 1 except that the infrared-absorbing dye was not used. However, this recording material could not record any image thereon.

EXAMPLE 2

Preparation of Capsule Solution 14 g of crystal violet lactone (leuco dye), 60 g of Takenate D-110N (trade name of a capsule wall material produced by Takeda Chemical Industries, Ltd.), and 2 g of Sumisorb 200 (trade name of an ultraviolet absorbent produced by Sumitomo Chemical Co., Ltd.) were added to and dissolved in a mixture of 55 g of 1-phenyl-1-xylylethane and 55 g of methylene chloride.

The solution thus obtained was mixed with 100 g of an 8 wt % aqueous solution of polyvinyl alcohol and an aqueous solution of 1.4 g of 2 wt % sodium salt of dioctyl sulfosuccinate (dispersant) in 40 g of water. The mixture was subjected to emulsification at 10,000 r.p.m. for 5 minutes by means of an Ace Homogenizer (produced by Nihon Seiki K.K.). To the emulsion thus obtained was added 150 g of water. The reaction system was then allowed to undergo a capsulization reaction at a temperature of 40° C. for 3 hours to prepare a capsule solution having an average grain size of 0.7 μm.

Preparation of Emulsion Dispersion of Developer 8 g of a developer (a) of the general formula:

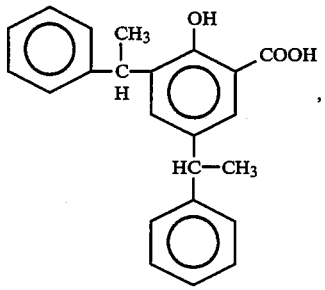

4 g of a developer (b) of the general formula:

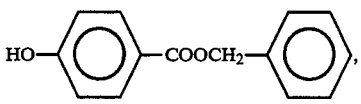

30 g of a developer (c) of the general formula:

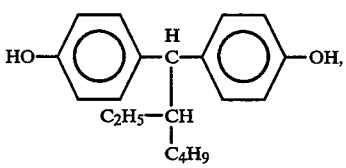

and 4 g of an infrared-absorbing dye of the following chemical structure:

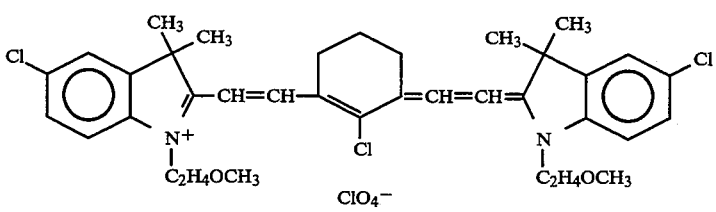

were dissolved in a mixture of 8.0 g of 1-phenyl-1-xylylethane and 30 g of ethyl acetate. The solution thus obtained was mixed with 100 g of an 8 wt % aqueous solution of polyvinyl alcohol and an aqueous solution of 0.5 g of sodium dodecylbenzenesulfonate in 150 g of water. The mixture was then subjected to emulsification at 10,000 r.p.m. by means of an .Ace Homogenizer (produced by Nihon Seiki K.K.) for 5 minutes at a normal temperature in such a manner that the average grain diameter reached 0.5 μm to obtain an emulsion dispersion.

Preparation of Heat-Sensitive Recording Material 5.0 g of the above-mentioned capsule solution, 10.0 g of the above-mentioned developer emulsion dispersion, and 5.0 g of water were mixed with stirring. The solution thus obtained was coated on a 70 μm thick transparent polyethylene terephthalate (PET) support in such a manner that the solid content reached 15 g/m$^2$, and then it was dried to form a heat-sensitive layer thereon. Further, onto the heat-sensitive layer was coated a protective layer solution of the composition set forth in Table 3 to a dried thickness of 2 μm to form a protective layer thereon. The material was then dried. Thus, a transparent heat-sensitive recording material of the present invention was prepared.

TABLE 3

| Composition of protective layer | |
|---|---|
| 10 wt % Polyvinyl alcohol | 20 g |
| Water | 30 g |
| 2 wt % Sodium salt of dioctyl sulfosuccinate | 0.3 g |
| Kaolin dispersion obtained by dispersing 3 g of polyvinyl alcohol, 100 g of water, and 35 g of kaolin with a ball mill | 3 g |
| Hydrin Z-7 (produced by Chukyo Yushi K.K.) | 0.5 g |

The resulting heat-sensitive recording material was then imagewise irradiated with a semiconductor infrared laser beam (GaAs junction laser) of a wavelength of 780 nm from the heat-sensitive layer side to obtain a blue image. The output of the laser beam was adjusted such that an energy of 40 mJ/mm$^2$ was obtained in 1 m sec. on the surface of the heat-sensitive layer in the recording material.

The resulting recorded image was measured for reflection density on the colored portion by means of a Macbeth densitometer. The result was 1.45.

EXAMPLE 3

A heat-sensitive recording material was prepared in the same manner as in Example 2 except that 2-anilino-3-methyl-6-N-ethyl-N-butylaminofluorane was used instead of crystal violet lactone. An image was recorded on the recording material to obtain a transparent black image. The thus obtained image was then measured for transmission density on the colored portion by means of a Macbeth densitometer. The result was 1.63.

EXAMPLE 4

A recording material was prepared in the same manner as in Example 2 except that the developers (a) and (b) were not used, the amount of the developer (c) used was changed to 25 g, and 10 g of Sumiriser WX-R (trade name of a product of Sumitomo Chemical Co., Ltd.) was added to the system. An image was then recorded on the recording material to obtain a transparent blue image. The thus obtained image was then measured for transmission density on the colored portion by means of a Macbeth densitometer. The result was 1.42.

EXAMPLE 5

A recording material was prepared in the same manner as in Example 2 except that 100 g of 10wt % gelatin was used instead of 100 g of an 8 wt % aqueous solution of polyvinyl alcohol. An image was recorded on the recording material to obtain a transparent blue image. The thus obtained image was then measured for transmission density on the colored portion by means of a Macbeth densitometer. The result was 1.45.

EXAMPLE 6

A heat-sensitive recording material was prepared in the same manner as in Example 3 except that the infrared-absorbing dye was replaced by an infrared-absorbing dye of the general formula:

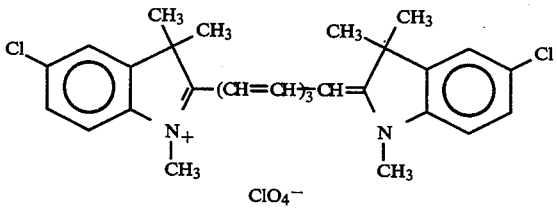

An image was recorded on the recording material to obtain a transparent black image. The thus obtained image was then measured for transmission density on the colored portion by means of a Macbeth densitometer. The result was 1.60.

EXAMPLE 7

A heat-sensitive recording material was prepared in the same manner as in Example 3 except that the infrared-absorbing dye was replaced by an infrared-absorbing dye of the general formula:

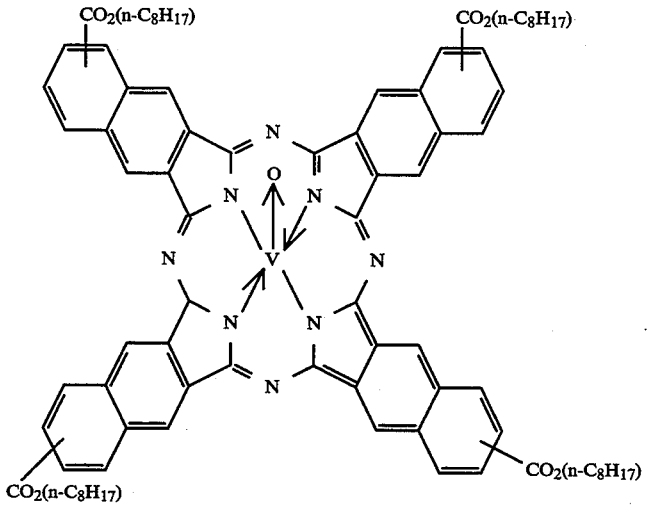

An image was recorded on the recording material to obtain a transparent black image. The thus obtained image was then measured for transmission density on the colored portion by means of a Macbeth densitometer. The result was 1.57.

COMPARATIVE EXAMPLE 2

A recording material was prepared in the same manner as in Example 2 except that the infrared-absorbing dye was not used. However, this recording material could not record any image thereon.

COMPARATIVE EXAMPLE 3

A dispersion was prepared by dispersing the compositions set forth in Table 4 instead of the developer emulsion dispersion used in Example 2 in such a manner that the average grain diameter thereof reached 2 μm.

TABLE 4

| | |
|---|---|
| Polyvinyl alcohol | 5 g |
| Developer (a) of the general formula: | 4 g |

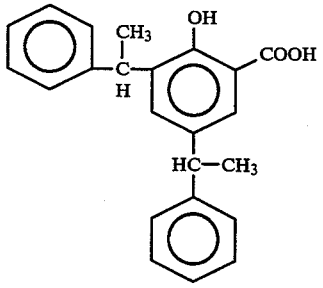

| | |
|---|---|
| Developer (b) of the general formula: | 2 g |

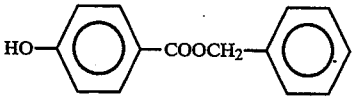

| | |
|---|---|
| Developer (c) of the general formula: | 15 g |

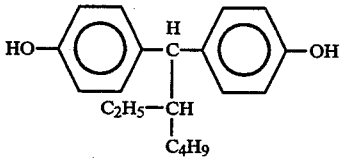

TABLE 4-continued

| | |
|---|---|
| Water | 100 g |

A coating solution was prepared by mixing 5 g of the same capsule solution as used in Example 2, 9 g of the above-mentioned dispersion, and 5 g of water. The coating solution thus obtained was coated on a 70 μm thick transparent polyethylene terephthalate (PET) support in such a manner that the solid content reached 15 g/m$^2$, and then it was dried. A protective layer was provided on the coat layer in the same manner as in Example 2 to prepare a heat-sensitive recording material.

An image was then recorded on the recording material thus prepared in the: same manner as in Example 2. The resulting image exhibited a low density and could not be put into practical use.

EXAMPLE 8

Preparation of Capsule Solution 14 g of 2-anilino-3-methyl-6 -N-ethyl-N-butylamino-fluorane (leuco dye), 60 g of Takenate D-110N (trade name of a capsule wall material produced by Takeda Chemical Industries, Ltd.), and 2 g of Sumisorb (trade name of an ultraviolet absorbent produced by Sumitomo Chemical Co., Ltd.), were added to and dissolved in a mixture of 55 g of 1-phenyl-1-xylylethane and 55 g of methylene chloride. The solution thus obtained was mixed With 100 g of an 8 wt % aqueous solution of polyvinyl alcohol and an aqueous solution of 1.4 g of 2 wt % sodium salt of dioctyl sulfosuccinate (dispersant)in 40 g of water. The mixture was subjected to emulsification at 10,000 r.p.m. for 5 minutes by means of an Ace Homogenizer (produced by Nihon Seiki K.K.). To the emulsion thus obtained was added 150 g of water. The reaction system was then allowed to undergo a capsulization reaction at a temperature of 40° C. for 3 hours to prepare a capsule solution having an average grain size of 0.7 μm.

Preparation of Emulsion Dispersion of Developer 8 g of a developer (a) of the general formula:

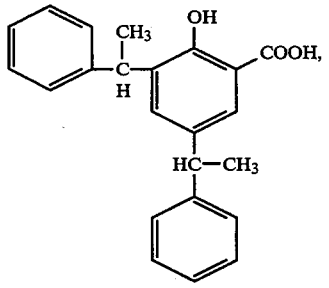

4 g of a developer (b) of the general formula:

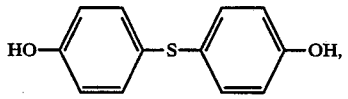

30 g of a developer (c) of the general formula:

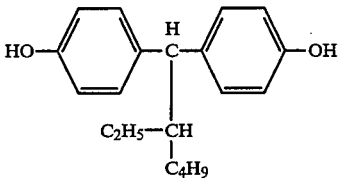

and 3 g of an infrared-absorbing decomposable dye (maximum absorption wavelength: 740 nm) of the general formula:

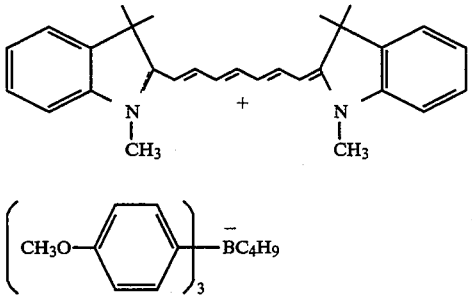

were dissolved in a mixture of 8.0 g of 1-phenyl-1-xylylethane and 30 g of ethyl acetate. The solution thus obtained was mixed with 100 g of an 8 wt % aqueous solution of polyvinyl alcohol and an aqueous solution of 0.5 g of sodium dodecylbenzenesulfonate in 150 g of water. The mixture was then subjected to emulsification at 10,000 r.p.m. by means of an Ace Homogenizer (produced by Nihon Seiki K.K.) for 5 minutes at a normal temperature in such a manner that the average grain diameter reached 0.5 μm to obtain an emulsion dispersion.

Preparation of Heat-Sensitive Recording Material 5.0 g of the above-mentioned capsule solution, 10.0 g of the above-mentioned developer emulsion dispersion, and 5.0 g of water were mixed with stirring. The solution thus obtained was coated on a 70 μm thick transparent polyethylene terephthalate (PET) support in such a manner that the solid content reached 15 g/m$^2$, and then it was dried to form a heat-sensitive layer thereon. Further, onto the heat-sensitive layer was coated a protective layer solution of the composition set forth in Table 5 to a dried thickness of 2 μm to form a protective layer thereon. The material was then dried. Thus, a transparent heat-sensitive recording material of the present invention was prepared.

TABLE 5

| Composition of protective layer | |
|---|---|
| 10 wt % Polyvinyl alcohol | 20 g |
| Water | 30 g |
| 2 wt % Sodium salt of dioctyl sulfosuccinate | 0.3 g |
| Kaolin dispersion obtained by dispersing 3 g of polyvinyl alcohol, 100 g of water, and 35 g of kaolin with a ball mill | 3 g |
| Hydrin Z-7 (produced by Chukyo Yushi K.K.) | 0.5 g |

The resulting heat-sensitive recording material was imagewise irradiated with a semiconductor infrared laser beam (GaAs junction laser) of a wavelength of 780 nm from the heat-sensitive layer side, and then it was irradiated with infrared rays from an infrared lamp to obtain a black recorded image. The output of the laser beam was adjusted such that an energy of 35 mJ/mm$^2$ was obtained in 1 m sec. on the surface of the heat-sensitive layer in the recording material.

The resulting recorded image was measured for reflection density on the colored portion by means of a Macbeth densitometer. The result was 1.55. After recording, the recording material showed no coloring on its background.

EXAMPLE 9

A heat-sensitive recording material was prepared in the same manner as in Example 8 except that 100 g of 10 wt % gelatin was used instead of 100 g of an 8 wt % aqueous solution of polyvinyl alcohol to be used in the preparation of capsule solution and developer emulsion dispersion. An image was recorded on the recording material to obtain a black image. The thus obtained image was then measured for transmission density on the colored portion by means of a Macbeth densitometer. The result was 1.56. The recording material showed no coloring on its background.

EXAMPLE 10

Preparation of Emulsion Dispersion B of Coupler, Base and Light-Absorbing Decomposable Dye

| Solution 1: | |
|---|---|
| 4 wt % Aqueous solution of polyvinyl alcohol | 170 parts by weight |

Solution 2:

The compositions set forth in Table 6 were mixed to prepare Solution 2.

TABLE 6

| | |
|---|---|
| Coupler of the general formula: | 1.4 parts by weight |

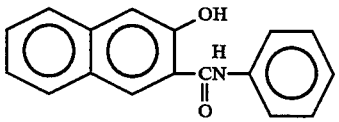

| | |
|---|---|
| Coupler of the general formula: | 1.4 parts by weight |

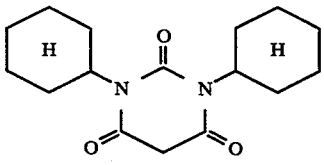

| | |
|---|---|
| Triphenyl guanidine (organic basic compound) | 6 parts by weight |
| Colorability improver of the general formula: | 14 parts by weight |

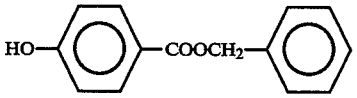

| | |
|---|---|
| Light-absorbing decomposable dye (maximum absorption wavelength: 658 nm) of the general formula: | 1 part by weight |

TABLE 6-continued

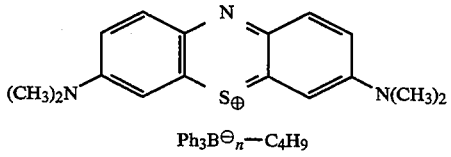

| | |
|---|---|
| Tricresyl phosphate | 10 parts by weight |
| Ethyl acetate | 20 parts by weight |

Solution 2 was added to Solution 1 in admixture. The mixture was then subjected to emulsification at a temperature of 20° C. to obtain Emulsion Dispersion B having an average grain diameter of 3 μm.

Preparation of Coating Solution

The compositions set forth in Table 7 were mixed to prepare a coating solution.

TABLE 7

| | |
|---|---|
| Capsule solution A | 4.9 parts by weight |
| 5 wt % Aqueous solution of hydroquinone | 0.2 part by weight |
| Dispersion B of coupler and base | 3.7 parts by weight |

Preparation of Protective Layer

The compositions set forth in Table 8 were mixed to prepare a protective layer.

TABLE 8

| | |
|---|---|
| Silica-modified polyvinyl alcohol (PVA R2105; trade name of a product of Kuraray Co., Ltd.) | 1 part by weight in terms of solid content |
| Colloidal silica (Snowtex 30; produced by Nissan Chemical Industries, Ltd.) | 1.5 parts by weight in terms of solid content |
| Zinc stearate (Hydrin Z-7; produced by Chukyo Yushi K.K.) | 0.02 part by weight in terms of solid content |
| Paraffin wax (Hydrin P-7; produced by Chukyo Yushi K.K.) | 0.02 part by weight in terms of solid content |

Preparation of Heat-Sensitive Recording Material

The coating solution thus obtained was coated on a 70 μm thick transparent polyethylene terephthalate (PET) support in such a manner that the solid content reached 15 g/m$^2$, and then it was dried to form a heat-sensitive layer thereon. Further, onto the heat-sensitive layer was coated the protective layer solution previously prepared in such a manner that the dried thickness reached 2 μm to form a protective layer thereon. Thus, a recording material was prepared.

The resulting recording material was imagewise irradiated with a He—Ne laser beam of a wavelength of 630 nm from the heat-sensitive layer side, entirely exposed to light from a fluorescent lamp to render the light-absorbing decomposable dye contained in the heat-sensitive layer colorless, and then fixed by means of Ricopy Super Dry 100 (produced by Ricoh Company Ltd.). The output of the laser beam was adjusted such that an energy of 40 mJ/mm$^2$ was obtained in 1 m sec. on the surface of the heat-sensitive layer in the recording material.

The resulting black recorded image was then measured for reflection density by means of a Macbeth reflection densitometer. The result was 1.22.

When the recorded image was projected through an overhead projector, a sharp black image with no stain even in its background on which no images had been recorded was displayed.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material for laser recording comprising a support having thereon a heat-sensitive layer comprising at least a first substantially colorless coloring component, a second substantially colorless coloring component which reacts with said first substantially colorless coloring component to develop a color, and an infrared-absorbing dye, wherein said first substantially colorless coloring component is present in microcapsules and said infrared-absorbing dye and said second substantially colorless coloring component are present outside microcapsules, wherein said first substantially colorless coloring component is a photodecomposable diazo compound and said second substantially colorless coloring component is a coupler, or said first substantially colorless coloring component is an electron-donating dye precursor and said second substantially colorless coloring component is a developer, and wherein the heat-sensitive layer is formed by coating a coating solution containing an emulsion obtained by dissolving said second substantially colorless coloring component and said infrared-absorbing dye in an organic solvent, which is slightly soluble or insoluble in water, and then emulsion-dispersing the solution in an aqueous medium.

2. A heat-sensitive recording material for laser recording as claimed in claim 1, comprising an infrared-absorbing dye which is rendered colorless by absorbing light in a specific wavelength range.

3. A heat-sensitive recording material for laser recording as claimed in claim 1, wherein said developer has a melting point of 50° C. to 250° C.

4. A heat-sensitive recording material for laser recording as claimed in claim 1, wherein said infrared-absorbing dye absorbs light in the near infrared range.

5. A heat-sensitive recording material for laser recording as claimed in claim 1, wherein said infrared-absorbing dye absorbs light having a wavelength of from 700 nm to 900 nm.

6. A heat-sensitive recording material for laser recording as claimed in claim 1, wherein said infrared-absorbing dye is a cyanine dye.

7. A heat-sensitive recording material for laser recording as claimed in claim 1, wherein said infrared-absorbing dye is selected from the group consisting of cationic dyes, complex-forming dyes and quinone neutral dyes.

8. A heat-sensitive recording material for laser recording as claimed in claim 1, wherein said infrared-absorbing dye is selected from the group consisting of thiol nickel complex dyes and phthalocyanine dyes.

9. A heat-sensitive recording material for laser recording as claimed in claim 1, wherein said infrared-absorbing dye is selected from the group consisting of naphthoquinone dyes and anthraquinone dyes.

* * * * *